United States Patent [19]

Brenner

[11] Patent Number: 4,939,852

[45] Date of Patent: Jul. 10, 1990

[54] ELASTIC FOOT SUPPORT TO BE BUILT-IN OR INSERTED IN SHOES

[76] Inventor: Edeltraud Brenner, Gartenstrasse 22a, 7918 Illertissen-Au, Fed. Rep. of Germany

[21] Appl. No.: 243,100

[22] PCT Filed: Dec. 8, 1987

[86] PCT No.: PCT/DE87/00579

§ 371 Date: Aug. 29, 1988

§ 102(e) Date: Aug. 29, 1988

[87] PCT Pub. No.: WO88/04898

PCT Pub. Date: Jul. 14, 1988

[30] Foreign Application Priority Data

Jan. 2, 1987 [DE] Fed. Rep. of Germany ..... 3700044

[51] Int. Cl.[5] ..... A43B 7/14; A61F 5/14

[52] U.S. Cl. ..... 36/44; 36/71; 128/621; 128/582

[58] Field of Search ..... 36/43, 44, 71, 91, 88; 128/586, 621, 623, 615, 605, 582

[56] References Cited

U.S. PATENT DOCUMENTS

| | | | |
|---|---|---|---|
| 492,994 | 3/1893 | Sawyer | 128/586 |
| 1,733,678 | 10/1929 | Torchia | 128/605 |
| 1,743,648 | 1/1930 | Appleton | 128/586 |
| 1,941,713 | 2/1934 | Parsons | 128/605 |
| 2,029,409 | 2/1936 | Brand | 128/623 |
| 2,083,581 | 6/1937 | Silver | 36/43 |
| 2,569,721 | 10/1951 | Juers | 128/586 |
| 2,600,864 | 6/1952 | Fuller | 128/605 |
| 4,658,516 | 4/1987 | Beck | 36/30 R |
| 4,715,131 | 12/1987 | Kremendahl | 36/43 |

FOREIGN PATENT DOCUMENTS

| | | | |
|---|---|---|---|
| 672252 | 2/1939 | Fed. Rep. of Germany | 128/586 |
| 896921 | 11/1953 | Fed. Rep. of Germany . | |
| 8517462 | 1/1986 | Fed. Rep. of Germany . | |
| 3700044 | 11/1988 | Fed. Rep. of Germany . | |
| 123413 | 11/1927 | Switzerland . | |

*Primary Examiner*—Steven N. Meyers
*Attorney, Agent, or Firm*—Herbert Dubno

[57] ABSTRACT

The invention relates to an elastic foot support, to be built-in or inserted in shoes consisting of a support plate made of an arched elastic flat material, which is provided in its frontal area with an elastically flexible support body with at least two toroidally shaped projection on its bottom side. According to the invention, the support plate (1) has in its frontal section a cut out (16) or a slot (3) running approximately symmetrical to its longitudinal axis; further, the support body (2) is fastened to the support plate (1) in such a way that parts of the support body are pressed through the cut out (16) or the slot (3) when weighted down by the foot of the wearer, thereby having a massaging effect upon the foot.

9 Claims, 2 Drawing Sheets

ELASTIC FOOT SUPPORT TO BE BUILT-IN OR INSERTED IN SHOES

Figure 1:
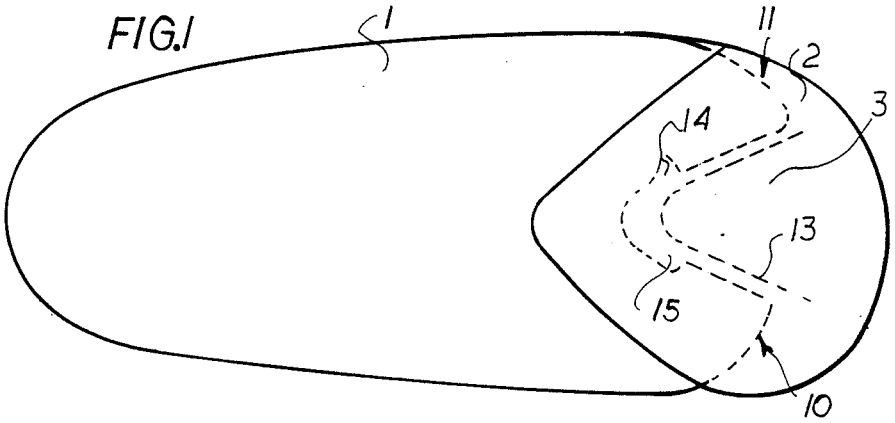

The invention relates to an elastic foot support to be built-in or inserted in shoes, consisting of a support plate made of an arched elastic flat material, preferably sheet steel, carrying an elastically flexible support body at its frontal portion, which serves for its support against the shoe sole.

Such elastic foot supports have the purpose to elastically support one segment of the foot bone structure, such as the metatarsus and/or the forefoot, in order to obtain relief, to avoid modifications of the bone structure, thereby generally making walking more pleasant. However, this objective can only be achieved with such foot supports when they can be readily adjusted to any shoe. This being the case, it is important that the support body—which is also called a pad—can be mounted or replaced on the support plate by a layman.

This is possible in a foot support as known from the German Utility Model No. G 85 17 462.9. In the insole known from this prior art publication, the support body is exchangeably superimposed with annular holders on at least two pins provided with spherical heads, or fastened thereto, whereby the two pins projecting from the bottom of the support plate are spot-welded to this plate.

The present invention improves upon this known foot support that consists of a support plate made of arched elastic flat material, which at its frontal portion is provided on its bottom with an elastically flexible support body having at least two toroidally shaped projections. An additional object of this invention is to shape the support plate and the thereto fastened support body so that this foot support has a massaging effect on the foot of the wearer.

For this purpose, the support plate according to the invention has in its frontal area a cut out running aproximately symmetrically to its longitudinal axis, or a corresponding slot, and furthermore the support body is fastened to the support plate in such a manner that some of its parts protrude through the cut-out or the slot, when the foot of the wearer presses against the support plate, exercising this way a massaging effect upon the foot.

Due to the rythmical pacing motion, respectively the alternate-side pressure on the support plate, a lifting motion of this plate results, which in turn exercises pressure on the flexible jaws, respectively toroidally shaped projections of the support body. Through the cut-out or the slot in the support plate, the padding mass is pushed upwardly performing a massage of the forefoot.

Suitably, the support body is designed like a flat pocket. The flat pocket can be fitted over the frontal portion of the support plate, which in addition has the advantage that it can be easily replaced by the layman, so that each time the support body having the most appropriate size can be fitted over the support plate.

In comparison with the arrangement according to the Utility Model No. G 85 17 462.9, an additional advantage results, namely that due to the fact that no fastening means have to be provided on the support plate, the arrangement according to the invention is much simpler.

An orthopedic foot support consisting of a support plate and support pad, whose support plate is provided with a fork-like shot in its frontal area is known from the German Pat. No. 896 921. However, here the support pad is fastened to the support plate by rivets and forms a mechanical unit with the plate. With this foot support it is neither possible nor intended to obtain a massaging effect.

Also, it is not possible to obtain the effect intended by the invention with the shoe insole according to the Swiss Pat. No. 123 413, since the pocket-like protection piece fitted over the frontal part of the support plate serves only for the protection of its edges. An interaction between the support plate and this protection piece does not exist in the known arrangement.

In an optimal embodiment of the invention, the slot in the support plate has the approximate shape of an isosceles triangle, whereby the mutually concurrent sides end in an almost circular rounding. For a better fit, the slot in the support plate can have arresting widenings, corresponding to the projections in the insertion pocket of the support body.

Further, it is recommended to subdivide the pocket of the support body in the longitudinal direction of the sole, in order to enable it to receive separately the two flanks of the slot. This arrangement presents the further advantage that it prevents a lateral displacement or tilting of the support body; it rather keeps its prescribed position forever.

As far as the support plate has only one cut out in its frontal area, the support body can be designed, for the point of view of its fastening to the support plate, like a double button reaching through the cut out. In this case, in order to fasten it to the support plate, a tongue made of an elastic material or an annular flange can be pulled through the cut out from underneath. This way, the support body is elastically connected to the support plate and parts of this support body, when under load, are pressed through the cut out and have a massaging effect upon the foot of the wearer.

The support plate itself is suitable made of sheet steel, having a thickness between 0.7 and 1.8 mm, preferably between 0.8 and 0.9 mm.

The support body itself is preferably produced as an expanded profiled body, whose contact surface with the foot is slidably finished. This slidability can, for instance, be produced by coating the surface with an appropriate layer such as teflon ®.

In order to increase the wear resistance of the support body, it is recommended to reinforce the support body in the area of the cut out or slot of the support plate.

Figure 2:
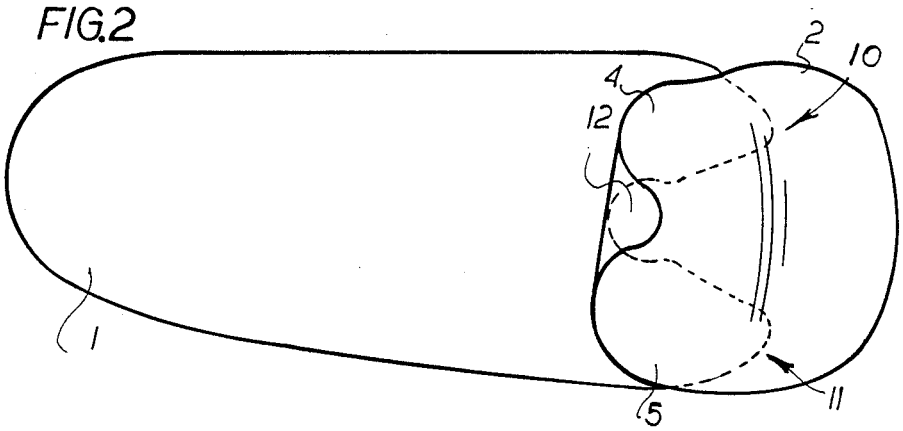
Figure 3:
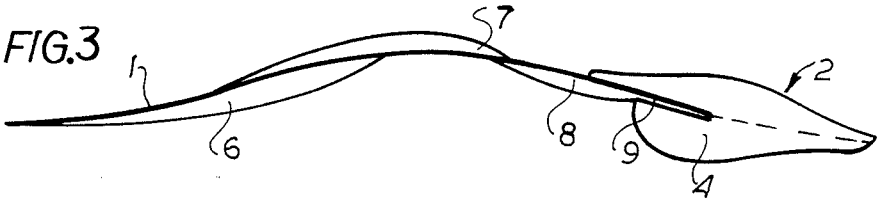
Figure 4:
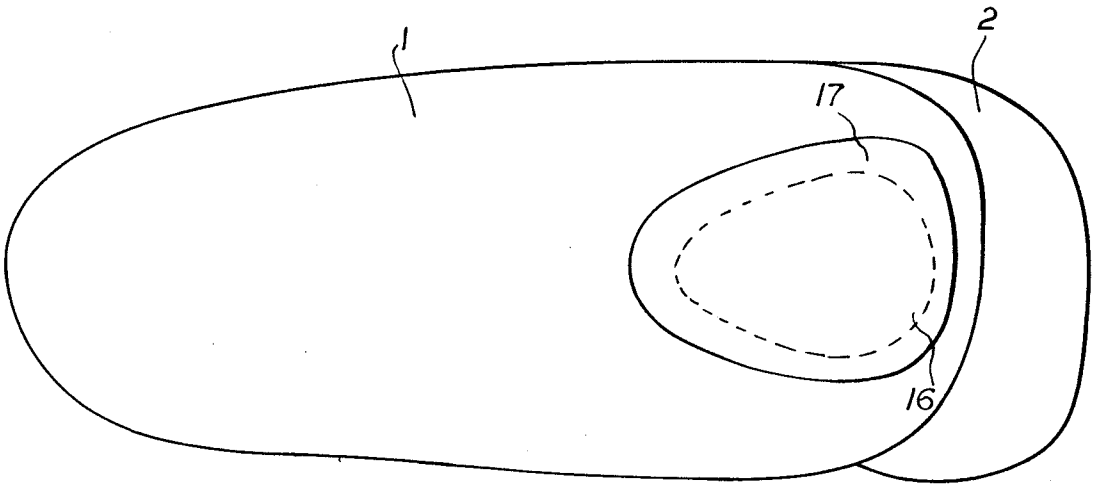

Embodiments of the invention are represented in the drawing, which shows:

FIG. 1 a top view of an embodiment of the elastic foot support,

FIG. 2 the same foot support seen from the bottom,

FIG. 3 the foot support according to FIGS. 1 and 2, in a lateral view, FIG. 4 a top view of a further embodiment of the foot support.

From the illustration in FIG. 3 there is shown support plate 1 made of flexible sheet steel arched in its longitudinal as well as its transversal direction. The arch is indicated in FIG. 3 by the parts 6, 7 and 8. In the embodiment according to FIGS. 1 and 3, the support plate 1 is provided in its frontal area with a slot 3, shaped almost like an isosceles triangle, whereby the mutally concurring side ends 10, 11 or a circular rounding. The support body 2 is designed like a pocket; it is fitted over the frontal area of the support plate 1 and engages with noses not shown in the drawings in the widenings 14 and 15 of the flanks 11 and 10. The pocket is subdivided into two sections by a separating seam 13, which insures a better fit on the flanks 10 and 11 of the support plate 1. The width of the horizontal slot 9 is so selected as to insure a genuine clamping effect of the support body 2 on the support plate 1.

The desired massage effect of the elastic foot support is a result of the fact that, during walking, when the support plate 1 is pressed through, the elastic pads 4 and 5 provided at the bottom of the support body 2 are pressed into the slot 3 of the support plate 1 and are thereby exercising pressure on the forefoot. This pressure changes continuously during the walking process, which explains the massaging effect.

This effect can optionally be improved by providing a circular widening 12 of the slot 3, which is shown only in FIG. 2.

In FIG. 4, another embodiment of the invention is represented, wherein the support plate 1 has a self-contained cut out 16. The support body 2 is different from the one in the embodiment of FIGS. 1 and 3 only due to the manner of its fastening to support plate 1. This takes place according to the principle of the double button, whose part 17 is inserted self-lockingly through the cut out 16.

In the represented embodiment, the support plate 1 consists of a sheet steel with a thickness of 0.8 mm. The support body 2 is preferably a profiled body of expanded material. When the, foot support is firmly built into a shoe, the support plate made of sheet steel or plexiglass can be perforated.

With the aid of FIG. 1, it has been explained that the pocket of the support body 2 can be subdivided into two parts by the indicated seams 13, so that two lateral pocket segments are created, which receive the shanks 10 and 11 of the support plate. In order to made sure that support bodies of various sizes can be fitted over support plates of various widths, it is recommended to design the pocket segments of the support body 2 in such a way that the support body itself be provided laterally with sufficiently large openings.

I claim:

1. An elastic foot support for insertion into shoes comprising:

a support plate with upper and lower major opposite surfaces, said support plate being in an arched form and having a frontal portion on an end thereof, said frontal portion including an aperture position approximately symmetrically with a longitudinal axis of said support plate; and an elastically flexible support body having at least two toroidally shaped projections on a botton surface thereof, said support body being fastened to said support plate in such a manner that some paart thereof presses through said aperture when said support plate is pressed downward by a foot and thereby provides a massaging effect upon said foot, and said support body overlapping both said upper and lower major opposite surfaces of said support plate.

2. A foot support according to claim 1 wherein a portion of said support body forms a pocket such that there is a space between said upper and lower major opposite surfaces.

3. A foot support according to claim 2 wherein said frontal portion includes a pair of flanks defining at least a part of said aperture and said pocket is divided along said longitudinal axis into two sections.

4. A foot support according to claim 3 wherein said aperture is a slot with a profile of an approximate isosceles triangle.

5. A foot support according to claim 4 wherein said slot has a plurality of indentations and said pocket has projections corresponding to said indentations for arresting same.

6. A foot support according to claim 1 wherein said support body includes a double button shaped formation, said formation penetrating said aperture such that respective portions of said button lie above and below said surfaces of said support plate.

7. A foot support according to claim 1 wherein said support body is a profile body of expanded material having a slidable finished contact surface with said foot.

8. A foot support according to claim 1 wherein said support plate consists of a sheet steel having a thickness between 0.7 and 1.8 mm.

9. A foot support according to claim 1 wherein said support plate consists of a sheet steet having a thickness between 0.8 and 0.9 mm.

* * * * *